United States Patent [19]

Arai et al.

[11] 3,945,951

[45] Mar. 23, 1976

[54] YELLOWING-PREVENTIVE DETERGENT COMPOSITION

[75] Inventors: Haruhiko Arai, Narashino; Junryo Mino, Kamagaya; Kimie Ide, Tokyo, all of Japan

[73] Assignee: Kao Soap Co., Ltd., Tokyo, Japan

[22] Filed: Sept. 21, 1973

[21] Appl. No.: 399,754

[30] Foreign Application Priority Data

Sept. 26, 1972 Japan ..... 47-96447

[52] U.S. Cl. ..... 252/546; 252/404; 252/406; 252/527; 252/532; 252/535; 252/539; 252/540; 252/550; 252/551; 252/554; 252/558; 252/559; 252/DIG. 2; 252/DIG. 11; 252/DIG. 15; 252/89 R

[51] Int. Cl.[2] ..... C11D 1/12

[58] Field of Search ..... 260/609 F; 252/404, 406, 252/539, 540, 89, 546, 551, 554, 558, 559

[56] References Cited

UNITED STATES PATENTS

| | | | |
|---|---|---|---|
| 3,057,926 | 10/1962 | Coffield | 260/609 F |
| 3,069,384 | 12/1962 | Coffield | 260/609 F |
| 3,274,258 | 9/1966 | Odenweller | 260/609 F |
| 3,382,178 | 5/1968 | Lissant et al. | 252/156 X |

*Primary Examiner*—Leland A. Sebastian
*Assistant Examiner*—E. Suzanne Parr
*Attorney, Agent, or Firm*—Woodhams, Blanchard and Flynn

[57] ABSTRACT

A detergent composition containing a non-coloring antioxidant to reduce yellowing of clothes. A detergent composition containing 0.001 to 5 percent by weight of a non-coloring antioxidant and 1 to 35 percent by weight of a metal-deactivating agent to reduce yellowing of clothes.

7 Claims, No Drawings

YELLOWING-PREVENTIVE DETERGENT COMPOSITION

BACKGROUND OF THE INVENTION

1. Field of the Invention

This invention relates to a detergent composition capable of minimizing yellowing of clothes.

2. Description of the Prior Art

When worn, clothes become contaminated with soils and stains such as sebum soils secreted from bodies, particles of dirt or dust, oil stains and the like. Detergents have been employed to remove physicochemically these soils or stains adhering on clothes, to restore the cleanliness of the clothes. However, as is well known in the art, none of the conventional detergents can remove such soils and stains completely and portions of the soils and stains remain in clothes after washing.

Various attempts have been made to obtain more complete removal of soils and stains. For instance, the physicochemical activities of detergents represented by surface active agents were at first utilized, and the biochemical activities of enzymes and the chemical activities of detergents represented by bleaching agents have been utilized. However, in spite of these efforts, complete removal of soils and stains has not yet been attained. Thus, small quantities of soils and stains are left on clothes and, as is well-known, these soils and stains accumulate by repetition of wearing and washing.

In view of the foregoing, it may be considered that in the detergent art it is desired to solve the important problem of attaining a complete removal of soils and stains. However, there is another important problem to be solved, i.e, the problem of preventing yellowing of fibrous clothes. The yellowing phenomenon is caused mainly by autoxidation of soils and stains left unremoved by washing, especially residual sebum soils.

A significant portion of the soil or dirt that adheres on clothes is sebum soil, about 50 percent by weight of which is unsaturated hydrocarbons and unsaturated aliphatic derivatives represented by squalene, triolein and oleic acid. It is confirmed that significant amounts of such unsaturated compounds are present in the soil or dirt that remains on clothes after washing. These unsaturated compounds undergo autoxidation and cause rancidity and give an offensive smell on wearing. Further, they cause yellowing even after washing. It is also known that yellowing by dye-stuffs and self-yellowing of fibers are due to autoxidation.

Various attempts have been made to provide detergent compositions capable of preventing or masking yellowing. For instance, redeposition preventing agents such as carboxymethyl cellulose and various fluorescent whitening agents are incorporated in detergents. However, the problem has not completely been solved as yet.

It is therefore a primary object of this invention to provide a detergent composition which can prevent or at least substantially reduce coloration and yellowing in clothes and generation of offensive smells.

SUMMARY OF THE INVENTION

This invention provides a detergent composition containing (1) a non-coloring antioxidant, or (2) a non-coloring antioxidant and a metal-deactivating agent in combination.

It is well known that antioxidants are incorporated in oils, fats and macromolecular compounds. These antioxidants do not react with oxygen, but rather react with radical residues or peroxides to deactivate them, cut the reaction chains of autoxidation and thus prevent degradation by oxidation. In order for the antioxidant to exert an oxidation-preventive effect sufficiently, it is necessary that it should be located in the vicinity of the radical residues or peroxides being formed, for reaction therewith. Accordingly, it is generally required that the antioxidants should have an excellent oxidation-preventive effect and should also have a good solubility in the oils, fats or macromolecular substances into which they are to be incorporated, so that they can be uniformly mixed therein. Additional requirements are imposed on antioxidants depending on the intended uses of the oils, fats or macromolecular substances.

When an antioxidant is to be incorporated as one component in a detergent composition, the required properties of the antioxidant should be considered from quite a different and unique viewpoint. More specifically, antioxidants that are to be incorporated in detergent compositions should satisfy all of the following requirements. The antioxidant must be able to be dispersed uniformly in an aqueous detergent solution. It must be adsorbed on fibrous articles selectively and effectively during the washing operation. It should possess a good compatibility with residual soil or dirt adhered on fibrous articles. When the antioxidant is exerting its oxidation-preventive effect in the washing solution, it should not itself color the fabric or undergo yellowing due to oxidation thereof. When it has completed exerting its oxidation-preventive effect and is transformed to a compound free of an oxidation-preventive effect, it should be promptly absorbed in the washing liquor without adversely affecting the fibrous articles. Since generation of offensive smells is caused not only by rancidity of soil or dirt during wearing, but also by microbial decomposition of sebum, it is desired that the antioxidant have a bacteriostatic activity.

Many antioxidants known to be useful for oils, fats and polymers cannot be used effectively in detergent compositions because they do not meet one or more of the foregoing special requirements. We have discovered a limited class of antioxidants which satisfy the foregoing requirements. These antioxidants are as follows: (1) Thiobisphenols having the following general formula (1):

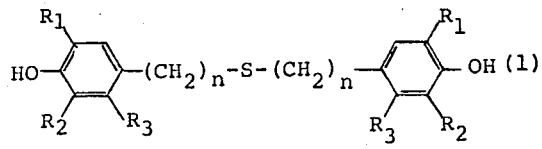

wherein n is 0 or 1, $R_1$ is an aliphatic hydrocarbon radical having 8 to 14 carbon atoms, especially alkyls of 8 to 14 carbon atoms, or a tert.-butyl radical, and $R_2$ and $R_3$ are hydrogen, or alkyl or hydroxyalkyl having 1 to 2 carbon atoms, with the proviso that at least one of $R_2$ and $R_3$ is said alkyl or hydroxyalkyl group.

Typical antioxidants encompassed by the above general formula 1. include 4,4'-thiobis(6-tert.-butyl-3-methylphenol), 4,4'-thiobis(6-tert.-butyl-2-methyl-phenol), bis(2-methyl-4-hydroxy-5-octylbenzyl) thio ether, etc.

Antioxidants belonging to this group are bifunctional antioxidants containing in one molecule both the phenol group which acts as a radical chain propagation inhibitor and the sulfur atom which acts as a peroxide-decomposing agent. They have excellent oxidation-preventive and non-coloring properties. Further, they show an excellent adsorbability on fibers because of the presence of the benzene ring and the long chain alkyl group. Moreover, we have found that the antioxidants belonging to this group have a bacteriostatic property as shown in Table 1.

Table 1*

| | Gram Positive Bacteria | | | | Gram Negative Bacteria | |
|---|---|---|---|---|---|---|
| | Staphylococcus aureus | | Bacillus subtilis | | Escherichia coli | |
| | Concentration | | Concentration | | Concentration | |
| | 500 ppm | 50 ppm | 500 ppm | 50 ppm | 500 ppm | 50 ppm |
| 4,4'-thiobis (6-tert.-butyl-3-methylphenol) | – | – | – | – | + | + |

*according to agar streak test method; " – " indicates inhibition of growth of bacteria; " + " indicates growth of bacteria 2. Radical chain propagation inhibiting agents:
4,4'-butylidene-bis(6-tert.-butyl-3-methylphenol)
2,2'-butylidene-bis(6-tert.-butyl-4-methylphenol)
mono- or di-styrenated cresol
mono- or di-styrenated phenol
1,1-bis(4-hydroxyphenyl)-cyclohexane
2,2'-methylene-bis(4-ethyl-6-tert.-butylphenol)
zinc salt of mercaptobenzimidazol
dimer or trimer of 2,2,4-trimethyl-1,2-dihydroquinoline In contrast, other known antioxidants including dibutylhydroxytoluene (BHT), dibutylhydroxyanisole (BHA), 2,2'-methylene-bis(6-tert.-butyl-4-methylphenol) and 2,6-di-tert.-butyl-4-methylphenol are not suitable for the purposes of this invention, because they have no yellowing-preventive effect and they have a high coloring property.

3. peroxide decomposing agents:
di-alkyl-3,3'-thiodipropionates (the alkyl group having 16 to 18 carbon atoms)
tris-alkyl-phenol phosphites (the alkyl group having 8 to 14 carbon atoms)

According to the invention, these non-coloring antioxidants are incorporated in conventional clothes washing detergent compositions in an amount of from about 0.001 to about 5 percent by weight, preferably 0.01 to 1 percent, based on the total weight of the detergent composition. In case the amount of the antioxidant is lower than about 0.001 percent by weight, the intended effect cannot be obtained. When the amount of the antioxidant exceeds about 5.0 percent by weight, the antioxidant itself becomes yellowed and incorporation of the antioxidant is ineffective.

These antioxidants have either no coloring property or an insignificant coloring property. They are excellent in their adsorbability on fibers and compatibility with residual soil or dirt. Accordingly, utilization of these antioxidants gives detergent compositions having an excellent yellowing-preventive effect. Thus, according to a first embodiment of the invention, the abovenamed antioxidants as used alone in detergent compositions to impart thereto an anti-yellowing property.

This yellowing-preventive effect is hindered to some extent by the presence of ions of metals such as calcium and magnesium which are contained in ordinary aqueous detergent washing solutions. According to a second embodiment of the invention these metal ions are deactivated.

Thus, the invention also provides a second type of detergent composition in which an especially excellent yellowing-preventive effect is attained by the synergistic activity of said non-coloring antioxidant as described above, used in combination with a metal-deactivating agent.

As the metal-deactivating agent to be used in the second type of detergent composition of this invention, there can be mentioned, for example, sodium nitrilotriacetate, sodium ethylenediaminetetraacetate, sodium citrate, sodium gluconate, tartaric acid, phytic acid, succinic acid, sodium polymaleate, copolymers or polymaleic acid with other copolymerizable vinyl monomers, sodium polyacrylate and the like.

The metal-deactivating agent is used in an amount of about 1 to about 35 percent by weight, preferably 15 to 30 percent, based on the total weight of the detergent composition.

The detergent composition of this invention comprises, as a base, a conventional clothes washing detergent composition containing as an active washing agent an anionic surfactant such as straight or branched chain alkylbenzene sulfonates, alkyl sulfates, α-olefin-sulfonates, alkyl sulfonates or an alkyl- or alkylphenol-polyoxyethylene ether sulfates, or a non-ionic surfactant such as polyoxyethylene alkyl ethers or polyoxyethylene alkylphenyl ethers, or mixtures of said anionic and non-ionic surfactants. There can also be present various conventional adjuncts including a builder component such as a condensed phosphoric acid salt, a carboxylic acid salt, a silicic acid salt or a boric acid salt, carboxymethyl cellulose or polyethylene glycol and as optional components an optical brightening agent and a perfume. The non-coloring antioxidant or the non-coloring antioxidant and the metal-deactivating agent are incorporated, as by mixing, in said basic detergent composition.

The basic clothes washing detergent compositions that can be used in the invention can be any of those suitable for clothes washing purposes. Since the basic detergent composition is not our invention, further description thereof is believed to be unnecessary.

Since the water-solubility of the antioxidant is relatively low, in order to disperse it sufficiently in the detergent solution, it is possible to employ the antioxidant in the form of granules formed by the use of polyethylene glycol, carboxymethyl cellulose or starch and Glauber's salt.

This invention will now be further described by reference to the following illustrative examples.

EXAMPLE 1

A yellowing-preventive detergent of the following recipe is prepared according to the conventional spray-drying method:

| Components | percent by weight |
|---|---|
| sodium alkylbenzene sulfonate | 15 |
| nonylphenol octaoxyethylene ether | 4 |
| sodium tripolyphosphate | 25 |
| sodium silicate | 7 |
| sodium carbonate | 2 |
| sodium sulfate | 34 |
| carboxymethyl cellulose | 1 |
| fluorescent dye | 0.4 |
| antioxidant (various — See Table 2) | 1 |
| perfume | as desired |
| water | balance |
| total | 100 |

The following test was conducted on each composition to determine the yellowing-preventive effect thereof.

An oily soil composed of a mixture of equal amounts of squalene, triolein and oleic acid was applied to a cloth of polyester:cotton (65:35) mixed spun fibers in an amount of 0.04 g per g of the cloth to form an oil-contaminated cloth. This cloth contaminated with the oily soil composed of the above unsaturated compounds was washed under the conditions indicated below. After the washing treatment, the washed cloth was allowed to stand still at a temperature of 40°C. and at a relative humidity of 80 percent for 20 days. The degree of yellowing was determined by measuring the b value by means of a color meter.

| Washing Conditions: | |
|---|---|
| detergent concentration: | 0.1 percent by weight |
| hardness of washing water: | 4° DH |
| washing temperature: | 20°C. |
| bath ratio: | 3 clothes (10 cm × 10 cm) /500 g of detergent solution |
| washing machine: | Terg-O-Tometer |

The results are shown in Table 2. When detergent compositions containing antioxidant were employed it was confirmed even by naked eye observation that a definite yellowing-preventive effect is attained except in the case of 2,2'-methylene-bis(6-tert.-butyl-4-methylphenol) and 2,6-di-tert.-butyl-p-cresol, as compared with the case where the washing was effected with the use of a detergent composition free of an antioxidant.

Table 2

| Antioxidant | b Value |
|---|---|
| not added (control) | 2.01 |
| 2,2-methylene-bis(6-tert.-butyl-4-methylphenol) (control) | 13.54 |
| 4,4'-butylidene-bis(6-tert.-butyl-3-methylphenol) | −0.85 |
| 2,6-di-tert.-butyl-p-cresol (control | 1.85 |
| 1,1-bis(4-hydroxyphenyl)-cyclohexane | −1.01 |
| styrenated phenol | −1.20 |
| tris-nonylphenyl phosphite | −0.56 |
| distearyl-3,3'-thio-dipropionate | 0.16 |

EXAMPLE 2

The following composition A was prepared by a conventional spray-drying method, and the following composition B was prepared by granulation. A detergent composition comprising 98 parts of the composition A and 2 parts of the composition B was prepared.

| Composition A | percent by weight |
|---|---|
| sodium alkylbenzenesulfonate | 18 |
| sodium tripolyphosphate | 25 |
| sodium carbonate | 4 |
| sodium silicate | 10 |
| sodium sulfate | 31 |
| carboxymethyl cellulose | 1 |
| fluorescent dye | 0.5 |
| perfume | as needed |
| water | balance |
| total | 100 |
| **Composition B** | **percent by weight** |
| polyethylene glycol (MW = 6000) | 11 |
| starch | 45 |
| carboxymethyl cellulose | 14 |
| antioxidant (See Table 3) | 20 |
| Glauber's salt | 10 |

Each of the above compositions was subjected to a long-time wear test, and the yellowing-preventive effect was determined. Two cotton knit underwears were worn alternately by an adult man each for one day and then washed. This procedure was continued for one month. One of the underwears was washed with the above detergent composition and the other was washed with a comparative detergent composition, i.e., the same composition except that it contained no antioxidant. The test was conducted on 10 adult men. The washing was performed by a washing machine under the following conditions; washing water=city water maintained at 20°C., detergent concentration=0.167 percent by weight, bath ratio=1 Kg/30l. The yellowing degree was determined by measuring the b value immediately after the month's test was completed and also after the test underwear had been allowed to stand still at a temperature of 20°C. and a relative humidity of 60 percent for 2 months from the termination of the one month's test. The results are shown in Table 3. From these results, it is seen that the oxidation-preventive effect was attained in the case of the compositions of this invention. This effect was apparent even by naked eye observation.

Table 3

| Antioxidant | b Value | |
|---|---|---|
| | just after wear test | after 2 months' standing |
| not added | −1.2 | 1.4 |
| tris-nonylphenyl phosphite | −4.8 | −4.0 |
| 1,1-bis(4-hydroxy-phenyl)-cyclohexane | −4.2 | −3.3 |

*the b value of the cotton knit underwears was −6.2 before the wear test.

EXAMPLE 3

The following composition C was prepared by a conventional spray-drying method, and the following composition D was prepared by granulation. A detergent composition was prepared by mixing 99 parts of the composition C with 1 part of the composition D.

| Composition C | percent by weight |
|---|---|
| sodium straight-alkylbenzenesulfonate | 18 |
| sodium tripolyphosphate | 25 |
| sodium silicate | 5 |
| sodium carbonate | 1 |
| carboxymethyl cellulose | 1 |
| sodium sulfate | 39.5 |
| fluorescent dye | 0.5 |
| water | 10 |
| total | 100 |
| Composition D | |
| 4,4'-thiobis(6-tert.-butyl-3-methylphenol) | 10 |
| carboxymethyl cellulose | 10 |
| polyethylene glycol (MW = 6000) | 10 |
| starch | 45 |
| sodium sulfate | 25 |
| total | 100 |

In order to examine the yellowing-preventive effect of this detergent composition, the following test was conducted.

An oily soil composed of a mixture of equal amounts of squalene, triolein and oleic acid was applied on a cloth of polyester:cotton (65:35) mixed spun fibers in an amount of 50 mg per g of the cloth. The thus-formed contaminated cloth was washed under the conditions indicated below, and the washed cloth was allowed to stand still at a temperature of 40°C. and a relative humidity of 80 percent for 20 days. Then, the degree of yellowing was determined by measuring the b value by means of a color meter.

| Washing Conditions: | |
|---|---|
| detergent concentration: | 0.1 percent by weight |
| Hardness of water used: | 4° DH |
| temperature: | 20°C. |
| bath ratio: | three cloths (10 cm × 10 cm) /500 cc of detergent solution |
| washing machine: | Terg-O-Tometer |
| Results obtained are shown in Table 4. | |

Table 4

| Detergent Composition | b Value |
|---|---|
| above detergent composition (I) of this invention | −3.8 |
| comparative detergent composition (II) (composition (I) but not containing antioxidant) | 1.5 |

*the b value of the starting cloth subjected to the test was −4.2

The composition (I) of this invention exhibited an extremely high yellowing-preventive effect, and the difference of the yellowing-preventive effect between the composition of this invention and the comparative composition could be definitely confirmed by naked eye observation.

EXAMPLE 4

The deodorizing effect on socks was examined with respect to the detergent compositions (I) and (II) described in Example 3. Cotton socks were worn by 10 adult men. The sock washed with the detergent composition (I) was put on the left foot and the sock washed with the detergent composition (II) was put on the right foot. The socks were worn for 1 day and after every wearing, they were washed with city water containing 0.1 percent by weight of the detergent composition and maintained at 30°C. After washing, the pairs of socks were compared with each other with respect to their offensive smell by a panel consisting of 5 men and 5 women. This test was repeated 6 times. The same tests were conducted by using nylon socks. The results are shown in Table 5, from which it is seen that the detergent composition of this invention had a deodorizing activity.

Table 5

| | Repetition Frequency | | | | | |
|---|---|---|---|---|---|---|
| socks | 1 | 2 | 3 | 4 | 5 | 6 |
| nylon | 8 | 7 | 10 | 17 | 16 | 19 |
| cotton | 0 | 3 | 18 | 10 | 13 | 12 |

Evaluation of the deodorizing effect by each examiner was made on the following scale; the points of 10 examiners were totalized to evaluate the deodorizing effect.

| Points | Judgment |
|---|---|
| 2 | IIS* is more smelly than IS* |
| 1 | IIS is a little more smelly than IS |
| 0 | no difference between IS and IIS |
| −1 | IS is a little more smelly than IIS |
| −2 | IS is more smelly than IIS |

*IS and IIS indicate socks washed with detergent composition (I) and socks washed with detergent composition (II), respectively.

Accordingly, a positive larger value in Table 5 shows a greater deodorizing activity of the detergent composition (I) of the present invention and a zero value shows no deodorizing effect.

EXAMPLE 5

In this example, the following recipe was used to prepare detergents E, F and G.

| Ingredient | percent by weight |
|---|---|
| sodium dodecybenzenesulfonate | 25 |
| sodium tripolyphosphate | X |
| sodium silicate | 5 |
| sodium carbonate | 1 |
| carboxymethyl cellulose | 1 |
| sodium citrate | Y |
| 4,4'-thiobis(6-tert.-butyl-3-methylphenol) | Z |
| sodium sulfate | balance |
| total | 100 |

The values of X, Y and Z for detergents E, F and G were as follows:

| | Detergent E | Detergent F | Detergent G |
|---|---|---|---|
| X | 20 | 15 | 20 |
| Y | 0 | 5 | 0 |
| Z | 0.1 | 0.1 | 0 |

The above three compositions were formed into slurrys, with the use of water, and they were spray-dried to form granular detergents. Using these three detergent samples, the following yellowing test was conducted.

An oily soil composed of a mixture of equal amounts of squalene, triolein and oleic acid was applied on a cloth of polyester:cotton (65:35) mixed spun fibers in an amount of 50 mg per g of the cloth. This unsaturated oil-contaminated cloth was washed under the following conditions and allowed to stand still at a temperature of 40°C. and a relative humidity of 80 percent for 20 days. The degree of yellowing was determined by measuring the b value by means of a color meter.

| Washing Conditions: | |
|---|---|
| detergent concentration: | 0.1 percent by weight |
| water used: | ion-exchanged water or water of hardness of 4° DH |
| temperature: | 20°C. |
| bath ratio: | three contaminated cloths (10 cm × 10 cm) /500 cc of detergent solution |
| washing machine: | Terg-O-Tometer |

Results are shown in Table 6.

Table 6

| Detergent | b Value | |
|---|---|---|
| | Washing Water | |
| | ion-exchanged water | water of hardness 4° DH |
| detergent E | −2.7 | −2.5 |
| detergent F | −3.1 | −3.5 |
| detergent G (control) | −1.1 | 0.5 |

From the results of Table 6, it is seen that the detergent E containing the antioxidant had a yellowing preventive effect as compared with the detergent G (free of the antioxidant) and the detergent F containing both the antioxidant and sodium citrate (metal-deactivating agent) exhibited a highly enhanced yellowing-preventive effect.

EXAMPLE 6

The following composition H was prepared by a conventional spray-drying method, and the composition I was prepared by granulation.

A detergent composition was prepared by mixing 99 parts of the composition H with 1 part of the composition I.

| Composition H | percent by weight |
|---|---|
| sodium salt of higher oxoalcohol sulfuric acid ester | 21 |
| metal-deactivating agent (sodium nitrilotriacetate or sodium citrate) | 20 |
| sodium silicate | 6 |
| sodium carbonate | 2 |
| carboxymethyl cellulose | 1 |
| fluorescent dye | 0.5 |
| sodium sulfate | 39.5 |
| water | 10 |
| total | 100 |
| **Composition I** | **percent by weight** |
| 4,4′ thiobis(6-tert.-butyl-2-methylphenol) | 5 |
| polyethylene glycol ($\overline{MW}$ = 6000) | 10 |
| water-soluble starch | 45 |
| carboxymethyl cellulose | 15 |
| sodium sulfate | 25 |
| total | 100 |

In order to examine the yellowing-preventive effect of this detergent composition, the following test was conducted.

Two cotton knit underwears were worn alternately by an adult man each for 1 day and then washed. This procedure was repeated for 1 month. One of the underwears was washed with the above detergent composition and the other underwear was washed with the comparative detergent composition (the same composition, except that it did not contain the antioxidant). The test was conducted by a panel consisting of 10 adult men.

The washing was carried out by using a washing machine under the following conditions: washing liquor = city water maintained at 20°C., detergent concentration = 0.167 percent by weight, bath ratio = 1 Kg/30l. After one month's wearing test, the sample underwears were allowed to stand still at a temperature of 20°C. and a relative humidity of 60 percent for 2 months. The degree of yellowing was determined by measuring the b valve by means of a color meter.

The results are shown in Table 7.

Table 7

| Metal-Deactivating Agent | b Value | |
|---|---|---|
| | just after wearing test | after standing still for 2 months |
| neither antioxidant nor metal-deactivating agent was added (sodium tripolyphosphate used instead) (control) | 0.8 | 2.5 |
| sodium citrate | −3.1 | −2.5 |
| sodium nitrilotriacetate | −3.9 | −3.0 |

The embodiments of the invention in which an exclusive property or privilege is claimed are defined as follows:

1. A clothes washing detergent composition having incorporated therein from 0.001 to 5 percent by weight of a compound of the formula

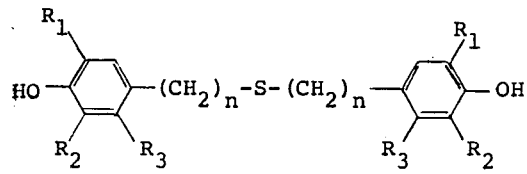

wherein n is 0 or 1, $R_1$ is an aliphatic hydrocarbon having 8 to 14 carbon atoms or tert.-butyl, and $R_2$ and $R_3$ are H, alkyl or hydroxyalkyl having 1 to 2 carbon atoms, with the proviso that at least one of $R_2$ and $R_3$ is said alkyl or hydroxyalkyl.

2. A composition according to claim 1, also containing from 1 to 35 percent by weight of a compound selected from the group consisting of sodium nitrilotriacetate, sodium ethylenediamine tetraacetate, sodium citrate, sodium gluconate, tartaric acid, phytic acid, succinic acid, sodium polymaleate, copolymers of polymaleic acid and other copolymerizable vinyl monomer, and sodium polyacrylate.

3. The detergent composition as claimed in claim 1, wherein the amount of the additive is from 0.01 to 1 percent by weight.

4. The detergent composition as claimed in claim 2, wherein the amount of the second additive is from 15 to 30 percent by weight.

5. The detergent composition as claimed in claim 1, in which said substance is selected from the group consisting of 4,4′-thiobis(6-tert.-butyl-3-methylphenol), 4,4′-thiobis(6-tert.-butyl-2-methyl-phenol)

and bis(2-methyl-4-hydroxy-5-octyl-benzyl) thio ether.

6. A clothes washing detergent composition as claimed in claim 1 containing as the active washing agent an anionic clothes washing surfactant selected from the group consisting of straight or branched chain alkylbenzene sulfonates, alkyl sulfonates, α-olefin sulfonates, alkyl sulfonates and alkyl-and alkylphenyl-ether sulfates.

7. A clothes washing detergent composition as claimed in claim 1 containing as the active washing agent a mixture of an anionic clothes washing surfactant selected from the group consisting of straight or branched chain alkylbenzene sulfonates, alkyl sulfates, α-olefin sulfonates, alkyl sulfonates and alkyl-and alkylphenyl-ether sulfates, and a nonionic clothes washing surfactant selected from the group consisting of polyoxyethylene alkyl ethers and polyoxyethylene alkylphenyl ethers.

* * * * *